US007594569B2

(12) United States Patent
Bass et al.

(10) Patent No.: US 7,594,569 B2
(45) Date of Patent: Sep. 29, 2009

(54) FRONT PACK TO FRONT FLAP MULTI-BACKPACK CONVERSION SYSTEM

(75) Inventors: Gregory Bass, Emeryville, CA (US); Andrew Walla, San Francisco, CA (US); Kim Tae, San Francisco, CA (US)

(73) Assignee: The North Face Apparel Corporation, Wilmington, DE (US)

( * ) Notice: Subject to any disclaimer, the term of this patent is extended or adjusted under 35 U.S.C. 154(b) by 0 days.

(21) Appl. No.: 11/781,265

(22) Filed: Jul. 22, 2007

(65) Prior Publication Data

US 2008/0116026 A1 May 22, 2008

Related U.S. Application Data

(60) Provisional application No. 60/832,616, filed on Jul. 24, 2006.

(51) Int. Cl.

| | |
|---|---|
| ***A45C 9/00*** | (2006.01) |
| ***A45C 13/10*** | (2006.01) |
| ***A45C 13/30*** | (2006.01) |
| ***A45F 4/02*** | (2006.01) |

(52) U.S. Cl. ..... 190/108; 190/27; 190/102; 190/902; 190/903; 224/153; 224/637

(58) Field of Classification Search ..... 190/18 A, 190/102, 103, 108, 902, 903, 16, 110, 1, 190/26, 27, 124; 224/153, 583, 637, 576
See application file for complete search history.

(56) References Cited

U.S. PATENT DOCUMENTS

| | | | | |
|---|---|---|---|---|
| 2,316,328 | A * | 4/1943 | Guenther et al. | 190/124 |
| 3,410,376 | A * | 11/1968 | Benzel | 190/110 |
| 3,786,972 | A * | 1/1974 | Alley | 224/417 |
| 3,989,080 | A * | 11/1976 | Koszegi | 383/40 |
| 4,756,394 | A * | 7/1988 | Cohen | 190/18 A |
| 4,883,207 | A * | 11/1989 | McArthur | 224/153 |
| 5,197,525 | A * | 3/1993 | Cantor | 150/102 |
| 5,547,052 | A * | 8/1996 | Latshaw | 190/108 |
| 5,706,992 | A * | 1/1998 | Moor | 224/657 |
| 5,743,447 | A * | 4/1998 | McDermott | 224/153 |
| 5,749,503 | A * | 5/1998 | Wulf et al. | 224/153 |
| 5,799,851 | A * | 9/1998 | Wulf et al. | 224/583 |
| 5,873,504 | A * | 2/1999 | Farmer | 224/576 |
| 6,098,769 | A * | 8/2000 | Yen | 190/108 |
| 6,189,750 | B1 * | 2/2001 | Von Neumann | 224/153 |
| 6,279,706 | B1 * | 8/2001 | Mao | 190/115 |
| D500,590 | S * | 1/2005 | Sachen | D3/216 |
| 2003/0164321 | A1 * | 9/2003 | Ukitsu et al. | 206/581 |
| 2004/0118891 | A1 * | 6/2004 | Esqueda | 224/639 |
| 2005/0077135 | A1 * | 4/2005 | Drew et al. | 190/102 |
| 2006/0207900 | A1 * | 9/2006 | Lytle | 206/315.9 |

* cited by examiner

*Primary Examiner*—Sue A Weaver
(74) *Attorney, Agent, or Firm*—Kenyon & Kenyon LLP

(57) ABSTRACT

A backpack assembly includes a luggage case having a first attachment interface and a backpack having a second attachment interface. The second attachment interface is configured to be mated with the first attachment interface to removably attach the backpack to the luggage case. The luggage case further includes a flap with a third attachment interface that is configured to be mated with the first attachment interface if the backpack is detached from the luggage case.

5 Claims, 9 Drawing Sheets

70

72

80

82

FRONT PACK TO FRONT FLAP MULTI-BACKPACK CONVERSION SYSTEM

This application claims the benefit of U.S. Provisional Application No. 60/832,616, filed Jul. 24, 2006.

BACKGROUND

1. Technical Field

Embodiments of the present invention generally relate to convertible backpacks. More particularly, embodiments relate to backpacks that are convertible between multi-pack configurations and single pack configurations.

2. Discussion

Luggage cases such as backpacks have long been used by hikers, athletes, and students in a wide variety of circumstances. Recent developments in backpack configurations have centered around the concept of a dual backpack assembly that can include a relatively large backpack having a smaller backpack attached to it. The dual backpack configuration may provide the user with more flexibility in the amount of gear to be toted. Conventional designs to the attachment system between the two packs may enable the smaller backpack to be zipped off of the larger backpack, wherein the zipper coils of the two packs are exposed while the packs are separated. Although dual backpack assemblies have grown in popularity, a number of challenges remain. For example, damage may occur to the exposed zipper coils of the two packs while they are detached from one another. Moreover, in conventional solutions the front face of the larger pack typically lacks storage capacity after the smaller pack is removed.

BRIEF DESCRIPTION OF THE DRAWINGS

The various advantages of the embodiments of the present invention will become apparent to one skilled in the art by reading the following specification and appended claims and by referencing the following drawings, in which:

DETAILED DESCRIPTION

Certain embodiments of the present invention provide for a luggage case having a first attachment interface, wherein the first attachment interface is configured to be mated with a second attachment interface of a backpack to removably attach the backpack to the luggage. The luggage case may also include a flap having a third attachment interface that is configured to be mated with the first attachment interface if the backpack is detached from the luggage case.

In another embodiment, a backpack assembly with multiple backpacks/luggage cases is provided. In particular, a luggage case can have a first attachment interface and a backpack can have a second attachment interface, wherein the second attachment interface is configured to be mated with the first attachment interface to removably attach the backpack to the luggage case. The luggage case may further include a flap with a third attachment interface that is configured to be mated with the first attachment interface if the second backpack is detached from the luggage case.

Another embodiment provides a method of converting a multi-pack configuration into a single-pack configuration in which a second backpack is removed from a first backpack by decoupling the attachment interfaces of the two packs. The method provides for opening a pouch containing a conversion flap The flap is extended from the pouch and coupled to the attachment interface of the first backpack.

A number of advantages such as increased storage capacity, enhanced protection for the attachment interfaces and improved appearance can be obtained through approaches such as these.

Figure 1B:
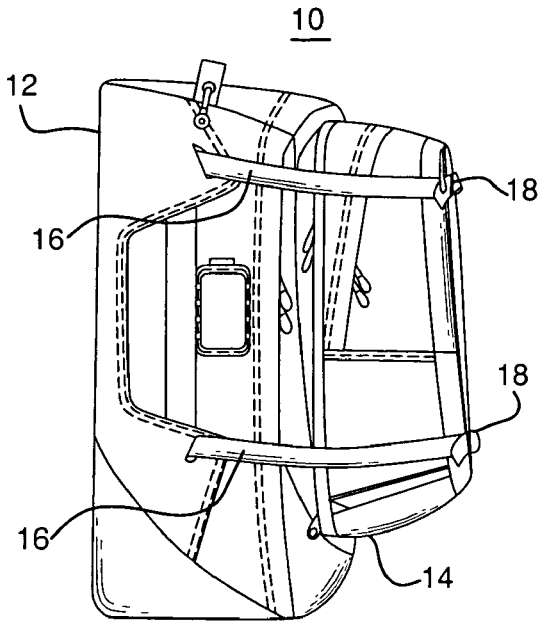
FIG. 1B is a side view of an example of the backpack assembly shown in FIG. 1A.
Figure 1A:
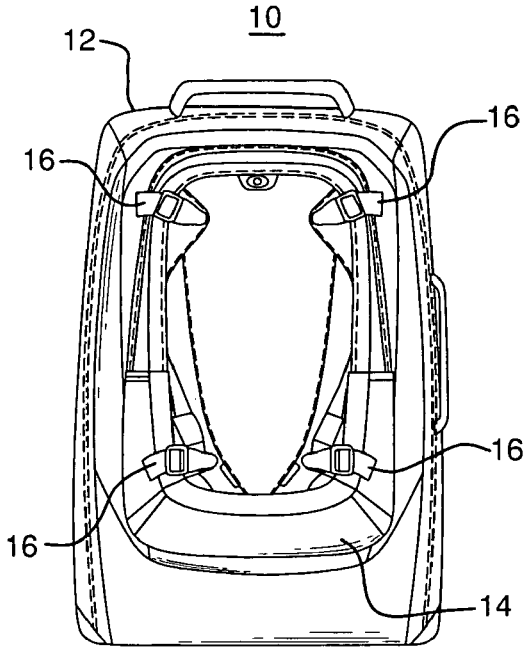
FIG. 1A is a front view of an example of a backpack assembly with a luggage case removably attached to a backpack according to an embodiment of the invention.
Figure 1C:
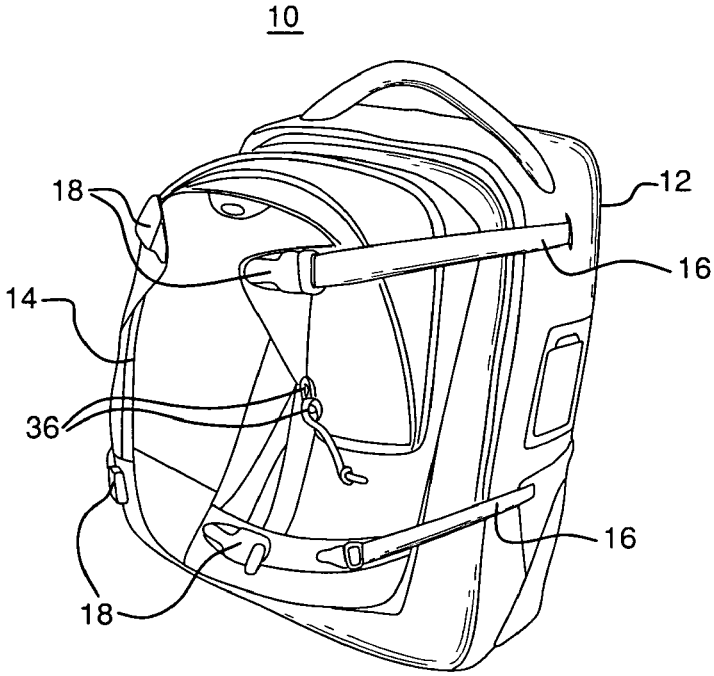
FIG. 1C is a perspective view of an example of the backpack assembly shown in FIGS. 1A and 1B.

Turning now to FIGS. 1A-1C, an example of a backpack assembly 10 is shown. The illustrated assembly 10 includes a luggage case 12 and a backpack 14. As will be described in greater detail, the luggage case 12 and backpack 14 are detachable so that the user of the assembly 10 can adjust the number of items and weight to be carried. For example, a traveler/hiker could take the assembly 10 on an extended trip lasting for several days, with bulkier items, such as a tent, sleeping bag, outer wear and boots packed into the larger luggage case 12. Less bulky items, however, such as food and water can be packed into the smaller backpack 14. Once the hiker arrives at a given destination, the bulky items (e.g., the tent and sleeping bag) can be used to set up camp, and the smaller backpack 14 can be used to take food and water on daily excursions. Thus, in this usage model, the smaller backpack 14 is used as a "daypack". Alternatively, the luggage case 12 could be used without the smaller backpack 14 in order to reduce the load on the individual. As will be discussed in greater detail, the luggage case 12 may also be used as a backpack. Other examples of the luggage case 12 include, but are not limited to, hard-sided luggage, soft-sided luggage, duffel bags, adventure travel packs and adventure travel luggage. Other examples of the backpack 14 include, but are not limited to, accessory bags, shoulder bags and briefs. The luggage cases, backpacks, conversion flaps, etc. described herein may be made of a wide variety of materials and/or fabrics, including, but not limited to, nylon, nylon with polymethane coating, cotton blends, polyester, plastic, etc.

Figure 7A:
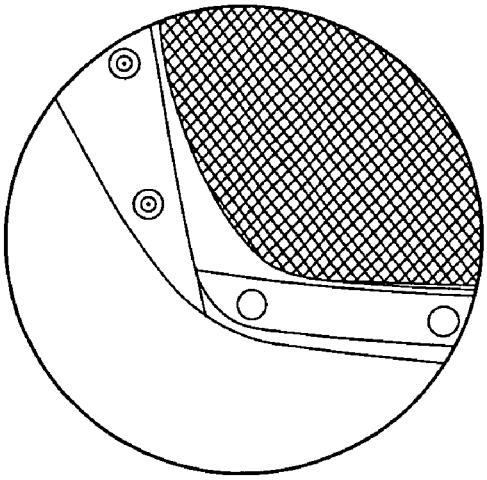
FIGS. 7A and 7B are enlarged views of examples of luggage case, conversion flap and pouch attachment interfaces having snaps according to an embodiment of the invention.
Figure 7B:
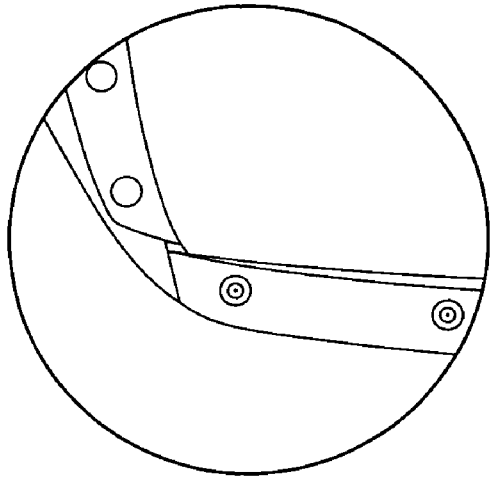
Figure 8A:
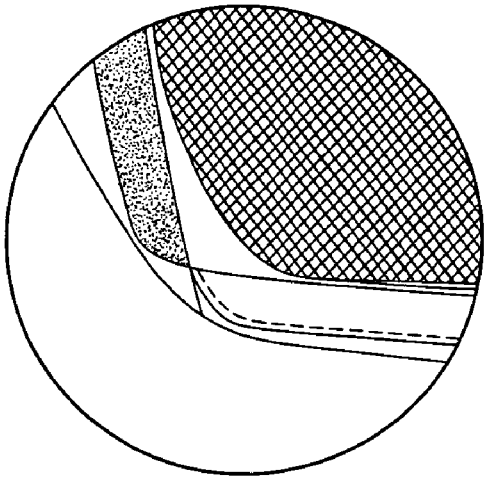
FIGS. 8A and 8B are enlarged views of examples of luggage case, conversion flap and pouch attachment interfaces having hook and loop fasteners according to an embodiment of the invention.
Figure 8B:
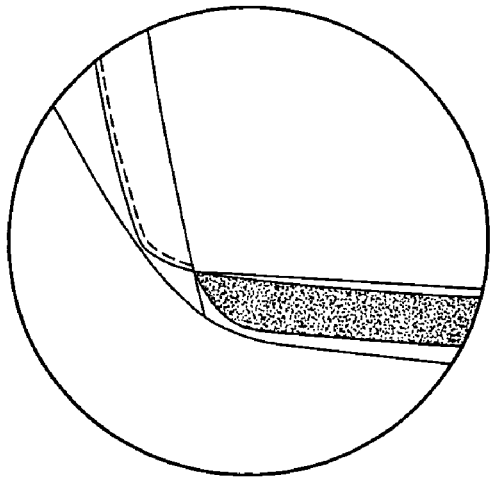

The attachment interfaces also can be of any suitable construction. For example, the backpack 14 can be removably attached to the luggage case 12 by a zipper (e.g., tracks with teeth or plastic rails as in Ziploc® zippers), buttons, snaps, buckles, hook and loop fasteners (e.g., Velcro® fasteners), etc. In particular, FIGS. 7A and 7B show pre-flap and post-flap installment configurations 70 and 72, respectively, in which the attachment interfaces include snap attachment components. FIGS. 8A and 8B show pre-flap and post-flap installment configurations 80 and 82, respectively, in which the attachment interfaces include hook and loop attachment components.

Notwithstanding, there are a number of aspects of the backpack assembly 10 for which zippers are well suited. For example, zippers may be particularly advantageous due to their ease of use and sealing ability. In the illustrated example, each of the luggage case 12 and backpack 14 is provided with a zipper half having teeth to enable selective attachment, as will be described in greater detail. The luggage case 12 can also include stabilizer straps 16 having male/female snap connectors that lock into female/male snap connectors 18 mounted on the front face of the backpack 14. The length of the straps 16 can be adjusted to compress the luggage case 12 and backpack 14 together so that the load in the storage compartments is stabilized. At best seen in FIG. 1C, the front face of the backpack 14 can have a storage pocket that is readily accessed by manipulating zipper slides 36. This can eliminate the need to access the main storage compartment of the backpack 14 for certain items.

Figure 4:
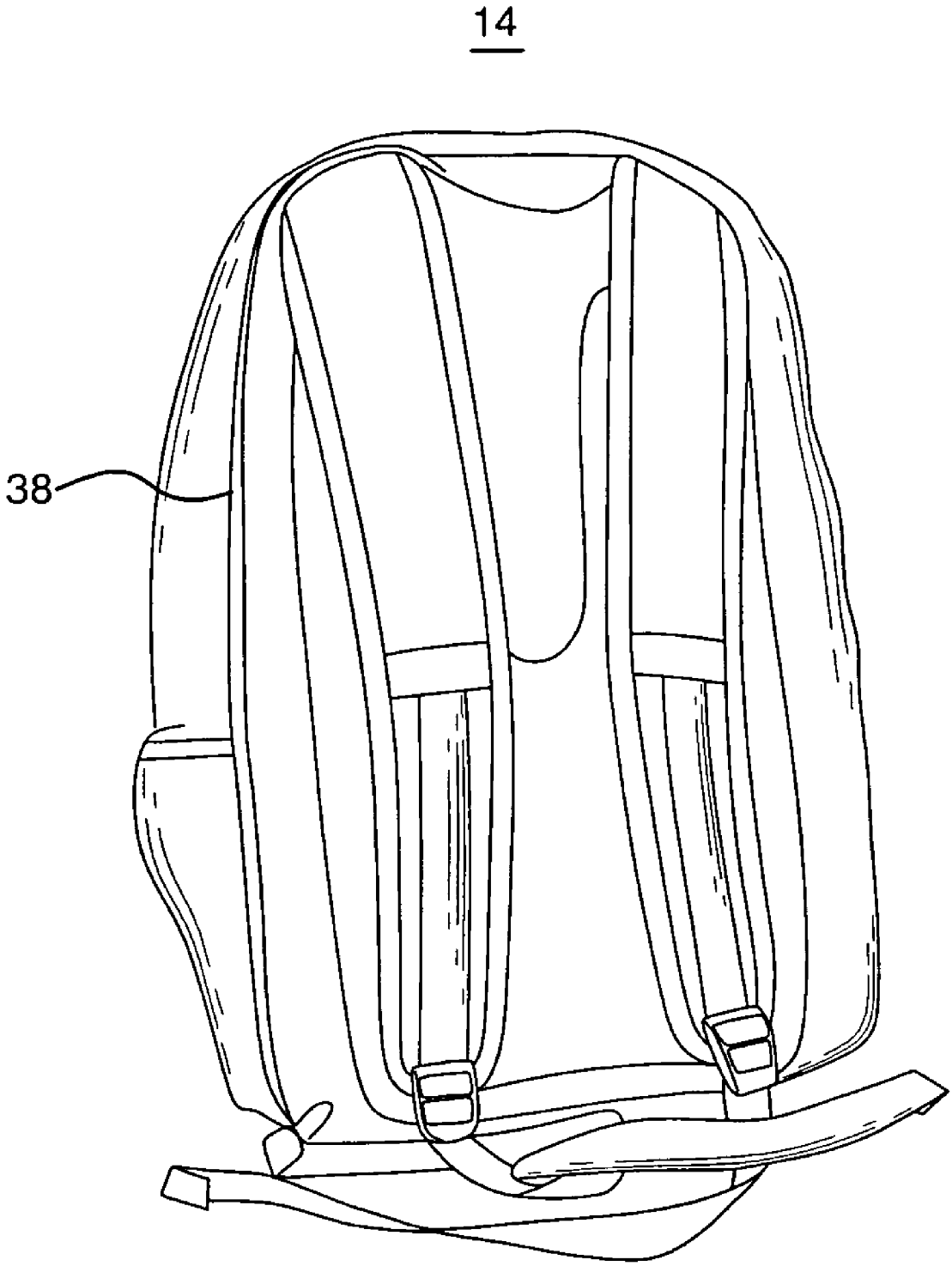
FIG. 4 is a rear view of an example of a daypack according to an embodiment of the invention.

FIGS. 2A-2D show an example of the luggage case 12 with the backpack 14 (FIGS, 1A-1C) removed. In particular, the luggage case 12 can have an attachment interface such as a zipper half 20, which may include zipper slides 22 coupled to a standard zipper track with metal or synthetic teeth, A corresponding zipper half 38 (as best shown in FIG. 4) may be provided on the backpack 14, wherein mating the two zipper halves 20, 38 attaches the backpack 14 to the luggage case 12.

The illustrated luggage case 12 also has a zippered pouch 24 and one or more pockets 26. The pockets 26 can provide for the storage of additional items. In particular, including such pockets 26 on the front face of the luggage case 12 provides for storage that is easily accessible without the need to open the main storage compartment of the luggage case 12. In order to prevent items stored in the pockets 26 from becoming dislodged, a stowable flap 30 can be installed within the pouch 24, where the flap 30 is pulled out to cover an opening 100 left by the removal of the backpack 14 from the luggage case 12. In particular, the illustrated pouch 24 includes a flap 30 that can be extended (as best shown in FIG. 2C) and mated with the zipper half 20 of the luggage case 12 to cover the pockets 26. The flap 30 can have a fixed end 40 that is sewn, or otherwise coupled to the interior of the pouch 24, and a free end 42 that may be manipulated to cover the opening 100 left by the removal of the backpack 14. Permanently attaching the flap 30 to the interior of the pouch 24 reduces the likelihood that the flap 30 will be misplaced in between uses.

Figure 2A:
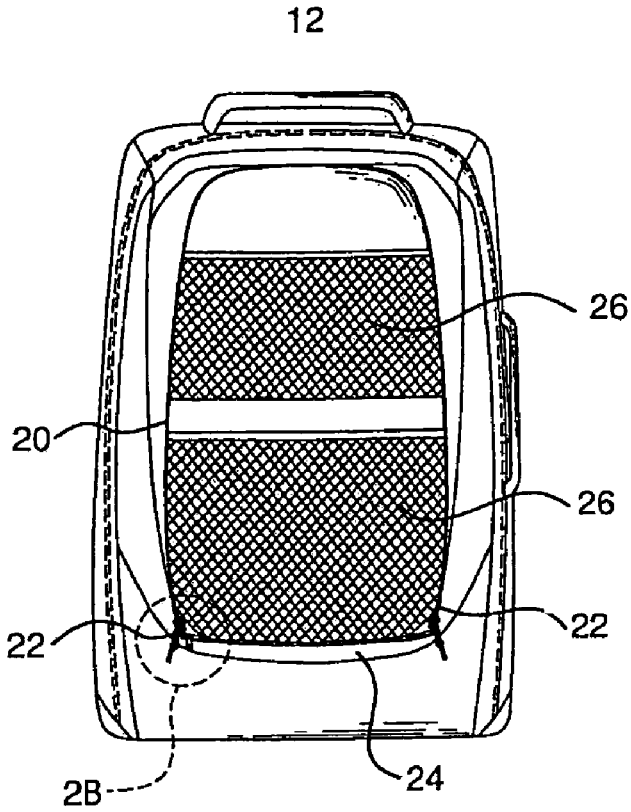
FIG. 2A is a front view of an example of a backpack assembly with the backpack detached from the luggage case according to an embodiment of the invention.
Figure 2B:
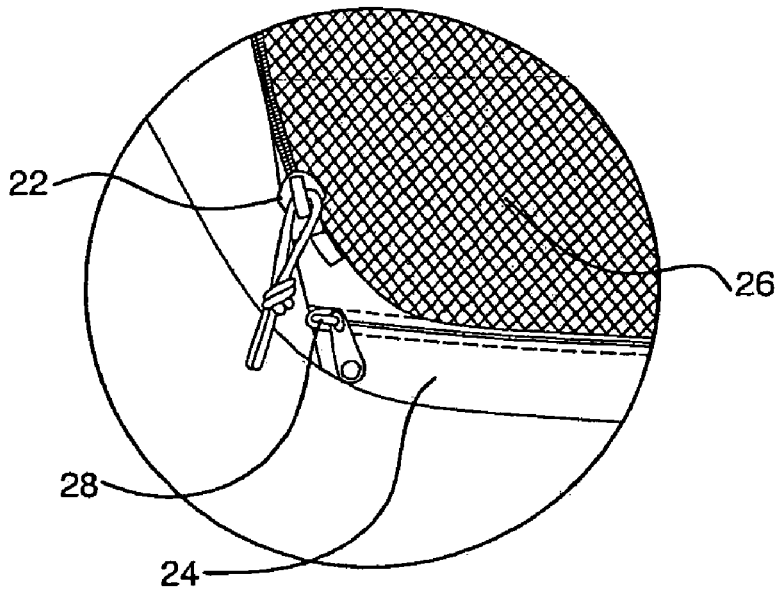
FIG. 2B is an enlarged view of an example of the region labeled 2B in FIG. 2A according to an embodiment of the invention.
Figure 2C:
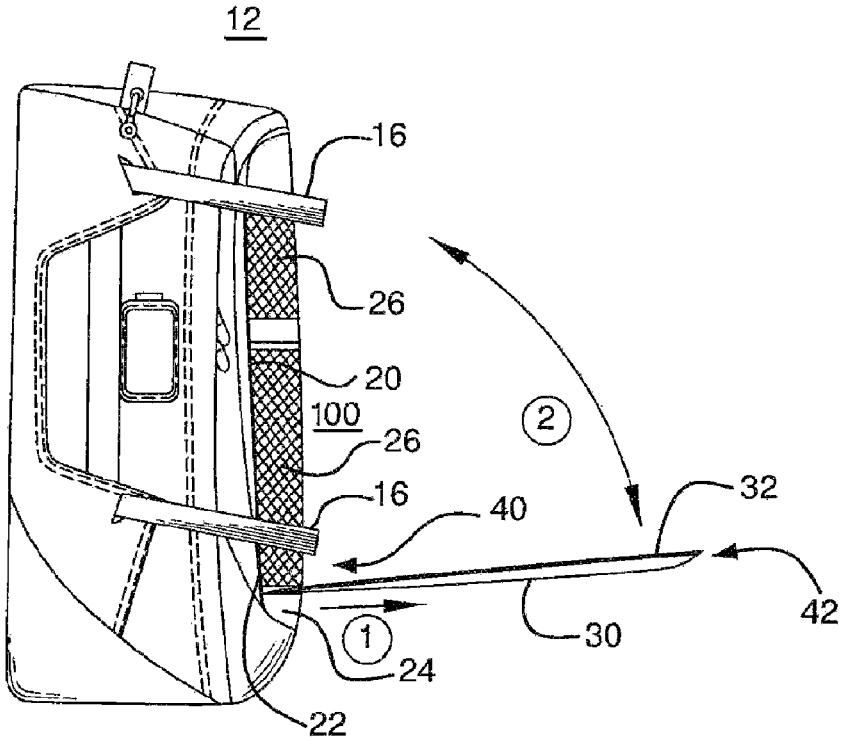
FIG. 2C is a side view of an example of the backpack assembly shown in FIG. 2A with a removably attachable conversion flap extended from the luggage case according to an embodiment of the invention.
Figure 2D:
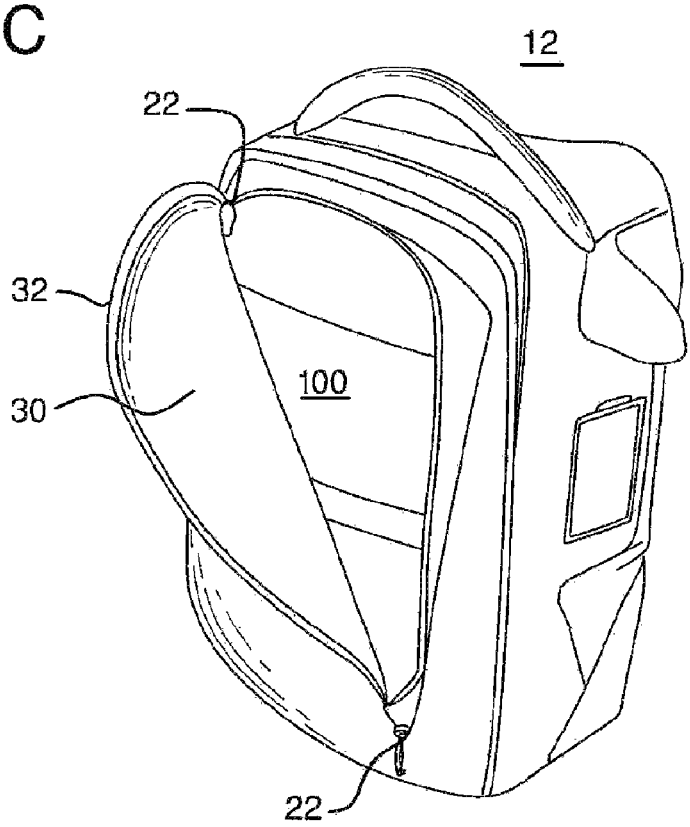
FIG. 2D is a perspective view of an example of the backpack assembly shown in FIGS. 2A and 2C with the conversion flap partially attached to the attachment interface of the luggage case according to an embodiment of the invention.
Figure 3A:
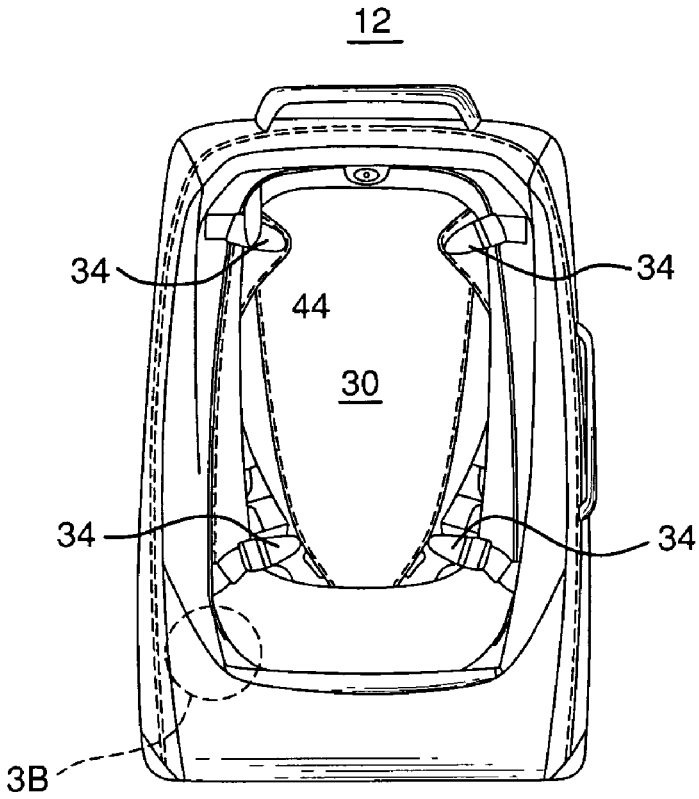
FIG. 3A is a front view of an example of a backpack assembly with the conversion flap fully coupled to the attachment interface of the luggage case according to an embodiment of the invention.
Figure 3B:
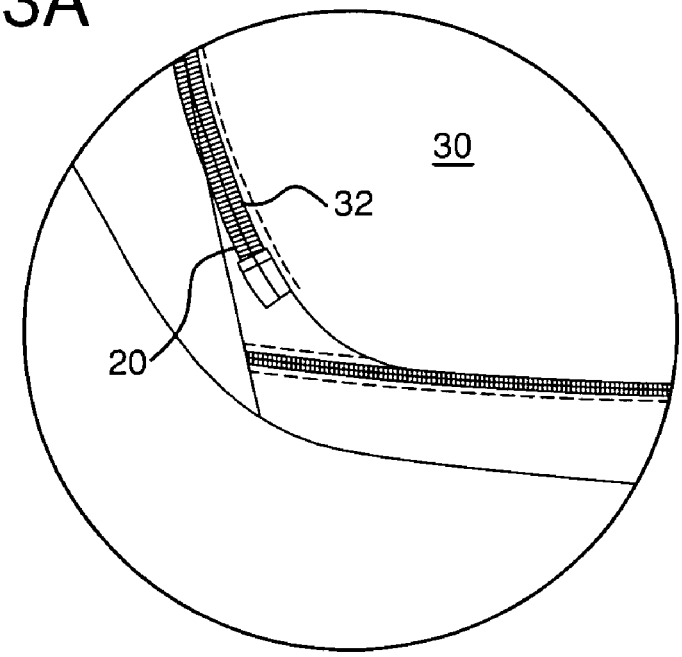
FIG. 3B is an enlarged view of an example of the region labeled 3B in FIG. 3A according to an embodiment of the invention.
Figure 3C:
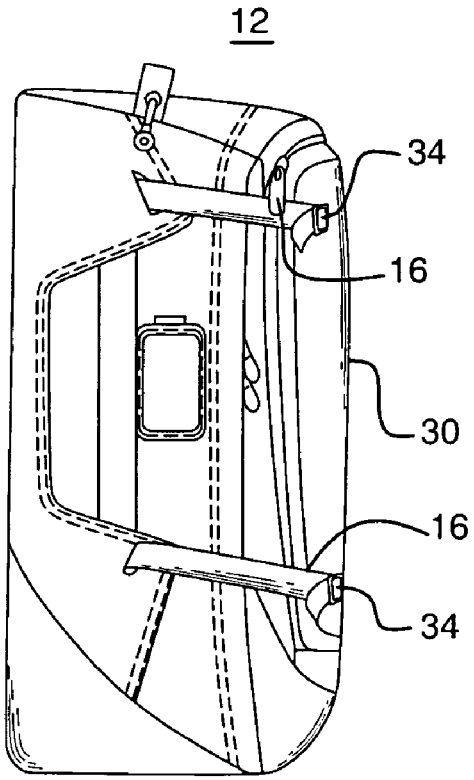
FIG. 3C is a side view of an example of the backpack assembly shown in FIG. 3A according to an embodiment of the invention.
Figure 3D:
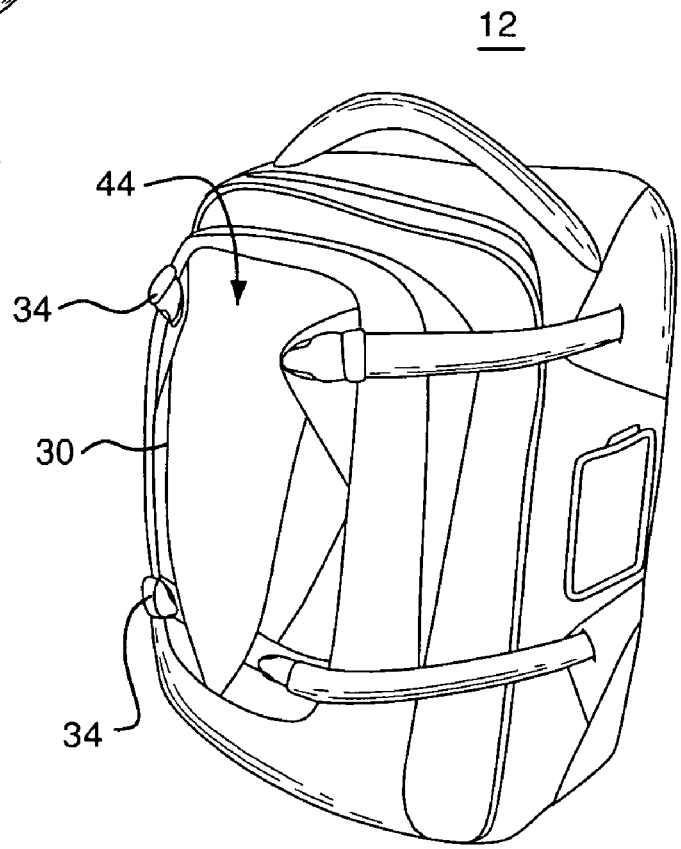
FIG. 3D is a perspective view of an example of the backpack assembly shown in FIGS. 3A and 3B according to an embodiment of the invention.

Thus, by simply using the zipper slide 28 (as best shown in FIG. 2B) to open the pouch 24, the flap 30 can be readily accessed. As already noted, the flap 30 may have an attachment interface such as zipper half 32, which can be mated with the zipper half 20 of the luggage case 12. In the illustrated example, the zipper half 32 of the flap 30 is very similar to the zipper half 38 (FIG. 4) of the backpack 14.

Turning now to FIGS. 3A-3D, an example of the luggage case 12 with the flap 30 fully installed is shown. The flap 30 can completely cover the opening formally occupied by the backpack 14, including the additional pockets 26 (FIGS. 2A-2D) mounted to the front face of the luggage case 12. The illustrated flap 30 also enables a much more aesthetically pleasing and finished appearance to be obtained for the luggage case 12 because the attachment interface is much less exposed, and decorative insignias 44, fabric combinations and stitching patterns can be more easily applied to the front face of the luggage case 12. In addition, the male/female snaps of the luggage case's stabilizer straps 16 can be configured to mate with corresponding female/male snaps 34 that are mounted on the front face side of the flap 30 to enable tightening and stabilization of the load within the luggage case 12.

Figure 5:
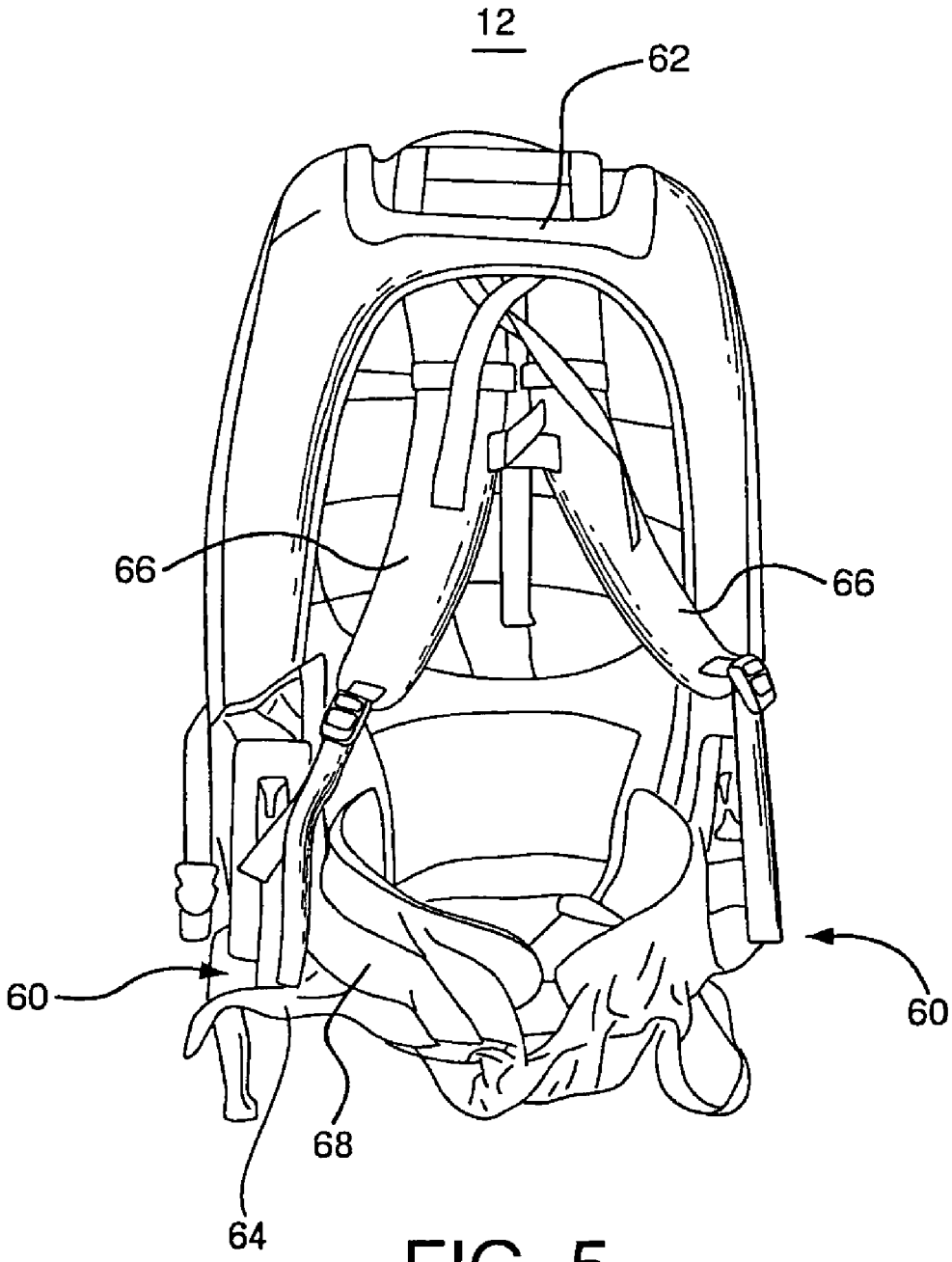
FIG. 5 is a rear view of an example of a luggage case configured to optionally function as a backpack according to an embodiment of the invention.

FIG. 5 demonstrates that the luggage case 12 may function as a piece of wheeled luggage or as a backpack. In particular, the illustrated luggage case 12 includes a pair of wheels 60 coupled to a bottom portion of the luggage case 12 as well as an extendable handle 62 coupled to a top portion of the luggage case 12, wherein extending the handle 62 in the upward direction and leaning the luggage case 12 back onto its wheels 60 facilitates use of the luggage case 12 in "pull-behind" mode. Alternatively, the luggage case 12 may be converted into a backpack by opening a free end of a second conversion flap 64 that is coupled to a back face of the luggage case 12, which exposes a pair of shoulder straps 66 and a waistbelt 68. In the illustrated example, various belts, straps and snaps provide for adjustment of the luggage case 12 to comfortably fit the body of the wearer. The luggage case 12 may also be configured to be converted into other types of functional bags, such as shoulder bags, etc.

Figure 6:
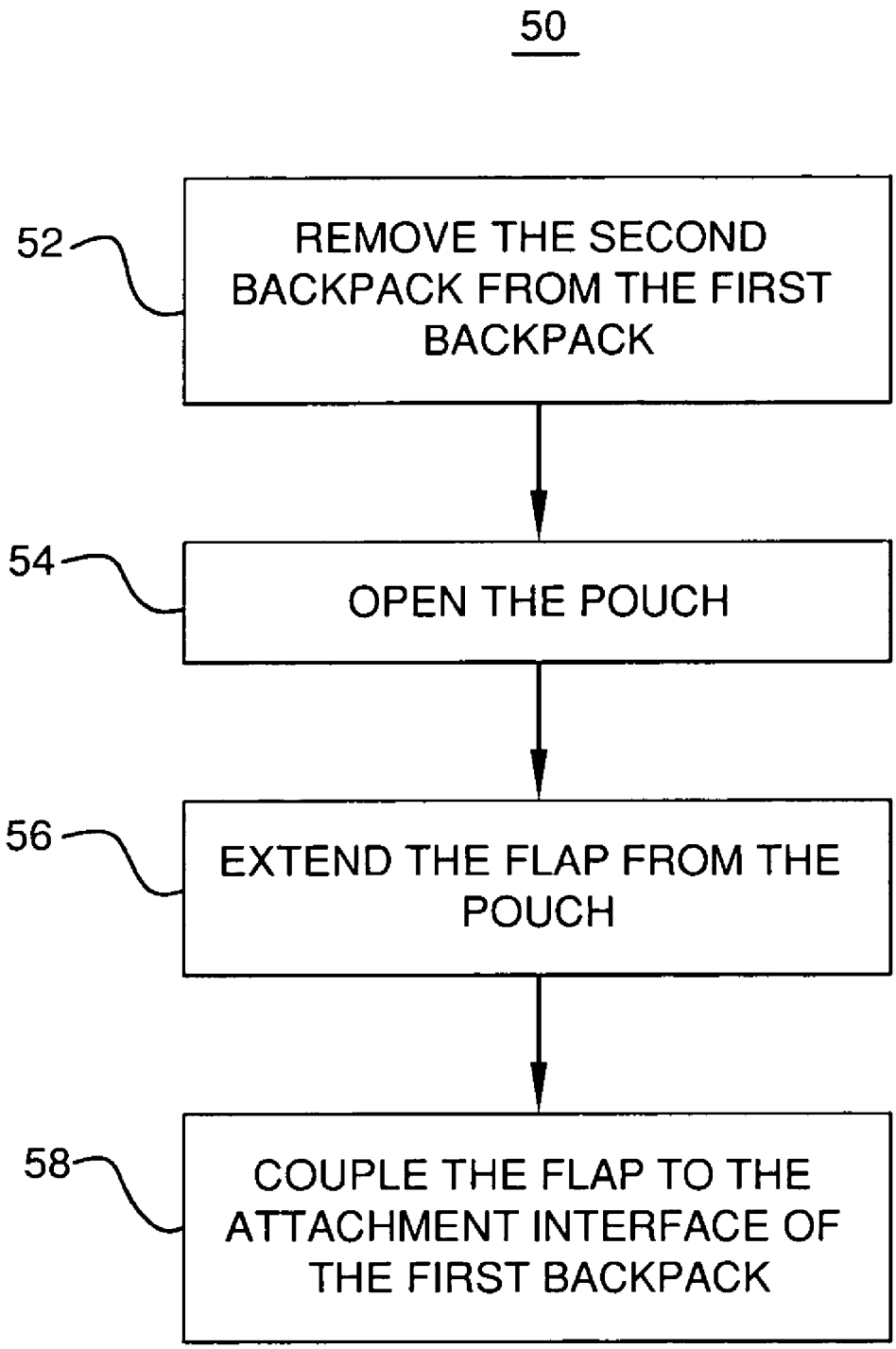
FIG. 6 is a flowchart of an example of a method of converting a multi-pack configuration into a single-pack; configuration according to an embodiment of the invention.

FIG. 6 shows a flowchart of an example of a method 50 of converting a multi-pack configuration into a single-pack configuration, wherein a luggage case is configured to function as a first backpack and a smaller backpack is configured to function as a second backpack in daypack mode. In the illustrated example, process block 52 provides for removing the second backpack from the first backpack. This can be achieved by de-coupling the attachment interface of the first pack from the attachment interface of the second pack. As already noted, this could involve unzipping two zipper halves, removing a series of buttons from corresponding button holes, de-coupling a series of male/female snaps, and so on. A storage pouch of the first pack is opened at process block 54 and a free end of a conversion flap is extended from the pouch at block 56. Process block 58 provides for coupling the flap to the attachment interface of the first backpack. The result is a finished larger backpack with additional storage capacity. In addition, the attachment interface is more durable because it is not left exposed when the two backpacks are detached.

The terms "coupled" and "attached" are used herein to refer to any type of relationship, direct, or indirect, between the components in question, and may apply to stitched, bonded, welded, laminated, or other connections. In addition, any use of the term "first", "second" and so on is only to facilitate discussion, and does not necessarily infer any type of temporal or chronological relationship.

Those skilled in the art will appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specifications, and following claims.

We claim:

1. A luggage case comprising:

a first attachment interface located on a front face of the luggage case, wherein the first attachment interface is configured to be mated with a second attachment interface located on a back face of a backpack to removably attach the backpack to the luggage case;

a flap having a third attachment interface that is configured to be mated with the first attachment interface if the backpack is detached from the luggage case, wherein the flap is configured to completely cover an opening left on the front face of the luggage case by the removal of the backpack; and a plurality of stabilizer straps each connected to the luggage case, each stabilizer strap having a first connector, a front face of the flap including a plurality of second connectors to mate with the first connectors, wherein tightening the stabilizer straps enables stabilization of a load within the luggage case.

2. The luggage case of claim 1, wherein the front face of the luggage case includes a pouch, the flap having a fixed end coupled to an interior of the pouch and a free end that is extendable from the pouch.

3. The luggage case of claim 2, wherein the front face of the luggage case farther includes a pocket, the flap to cover the pocket if the third attachment interface of the flap is mated with the first attachment interface of the luggage case.

4. The luggage case of claim 1, further including a second flap having a fixed end coupled to a rear face of the luggage case, a free end of the second flap being detachable from the rear face of the luggage case to expose a pair of shoulder straps and a waistbelt.

5. The luggage case of claim 1, wherein the first attachment interface is a zipper half, and wherein the first zipper half includes a pair of zipper slides coupled to the first zipper half.

* * * * *